US006845648B1

(12) United States Patent
English

(10) Patent No.: US 6,845,648 B1
(45) Date of Patent: Jan. 25, 2005

(54) HINGED CHIMNEY FLASHING FABRICATION TOOL

(76) Inventor: Jody English, 198 Rock St., Battle Creek, MI (US) 49014

( * ) Notice: Subject to any disclaimer, the term of this patent is extended or adjusted under 35 U.S.C. 154(b) by 0 days.

(21) Appl. No.: 10/752,273

(22) Filed: Jan. 6, 2004

Related U.S. Application Data

(63) Continuation-in-part of application No. 10/372,542, filed on Feb. 24, 2003, now Pat. No. 6,681,613.

(51) Int. Cl.[7] ..... B21D 5/16; B21D 11/20
(52) U.S. Cl. ..... 72/457; 72/477; 72/319
(58) Field of Search ..... 72/319, 457, 458, 72/477, 478, 479

(56) References Cited

U.S. PATENT DOCUMENTS

| | | | | | |
|---|---|---|---|---|---|
| 944,566 | A | * | 12/1909 | Mason | 72/458 |
| 3,248,921 | A | * | 5/1966 | Trout | 72/319 |
| 3,352,466 | A | | 11/1967 | McAllister | 223/38 |
| 3,848,454 | A | | 11/1974 | Hall | 72/457 |
| 3,859,834 | A | * | 1/1975 | Riley | 72/319 |
| 4,148,205 | A | * | 4/1979 | Boysen | 72/176 |
| 4,191,043 | A | | 3/1980 | Schaffer | 72/319 |
| 4,934,175 | A | * | 6/1990 | Hensler et al. | 72/458 |
| 5,199,294 | A | * | 4/1993 | Murczek | 72/457 |
| 5,836,198 | A | * | 11/1998 | Guilford | 72/458 |
| 6,681,613 | B1 | * | 1/2004 | English | 72/457 |

* cited by examiner

*Primary Examiner*—David Jones
(74) *Attorney, Agent, or Firm*—Sturm & Fix LLP

(57) ABSTRACT

A fabrication tool (10) for fabricating flashing (200) that surrounds a chimney (100) wherein, the fabrication tool (10) comprises an elongated rectangular base plate member (20) and an elongated rectangular top plate member (40) having a longitudinal stamped recess (42) that is laterally offset from the longitudinal axis of the top plate member (40) wherein, the bottom surface of the recess is permanently affixed to the base plate member (20) to define different depth bending slots (71) (72) to bend strips of sheet metal flashing (200) into a desired configuration; and, wherein, the base plate member (20) includes a pair of base plate member segments (20') (20") and the top plate member (40) includes a pair of top plate member segments (40') (40") wherein, segments (20') (40') and (20") (40") are co-joined together and hingedly connected to one another by a hinge unit (50).

12 Claims, 3 Drawing Sheets

HINGED CHIMNEY FLASHING FABRICATION TOOL

CROSS REFERENCE TO RELATED APPLICATIONS

This application is a continuation in part an improvement over my patent application Ser. No. 10/372,542, filed on Feb. 24, 2003 now U.S. Pat No. 6,681,613, and entitled "Chimney Flashing Fabrication Tool," the subject matter of which is incorporated herein by reference.

BACKGROUND OF THE INVENTION

1. Field of the Invention

The present invention relates to the field of sheet metal bending tools in general and in particular to a one step chimney flashing fabrication tool.

2. Description of Related Art

As can be seen by reference to the following U.S. Pat. Nos. 4,191,043; 3,838,454; and, 3,352,466, the prior art is replete with myriad and diverse sheet metal bending tools.

While all of the aforementioned prior art constructions are more than adequate for the basic purpose and function for which they have been specifically designed, they are uniformly deficient with respect to their failure to provide a simple, efficient, and practical sheet metal bending tool that is specifically designed for the purpose of fabricating flashing strips for chimneys.

As anyone in the building trades is well aware, when a residence is equipped with a functional chimney, all building codes require that an exterior sheet metal flashing be installed around the periphery of the chimney at the juncture of the chimney with the roof line.

As a consequence of the foregoing situation, there has existed a longstanding need in the building trades for a new and improved sheet metal bending tool that is specifically designed to quickly and easily form contoured flashing strips in a one step operation that can be performed on the roof adjacent to the chimney, and the provision of such a device is the stated objective of the present invention.

BRIEF SUMMARY OF THE INVENTION

Briefly stated, the hinged flashing fabrication tool that forms the basis of the present invention comprises in general a base plate member and a top plate member and a hinged connector wherein, a stamped recess is formed in the top plate member and the bottom of the stamped recess is fixedly connected to the top of the base plate member.

As will be explained in greater detail further on in the specification, the stamped recess is offset in a parallel relationship to the longitudinal axis of the top plate member to form two different depth bending slots wherein, the depth of the stamped recess defines the width of each of the bending slots.

Furthermore, the width of the stamped recess creates a stiffening rib for the top plate member relative to the base plate member to maintain the width of the openings on the outboard ends of the fabrication tool when subjected to the bending of precut strips of sheet metal to fabricate flashing strips for the periphery of chimney stacks on a roof line of a house or the like.

In addition, the improved hinged flashing fabrication tool of this invention is both collapsible into a compact configuration and provided with a locking arrangement to maintain the flashing fabrication tool in its collapsed configuration during transport.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
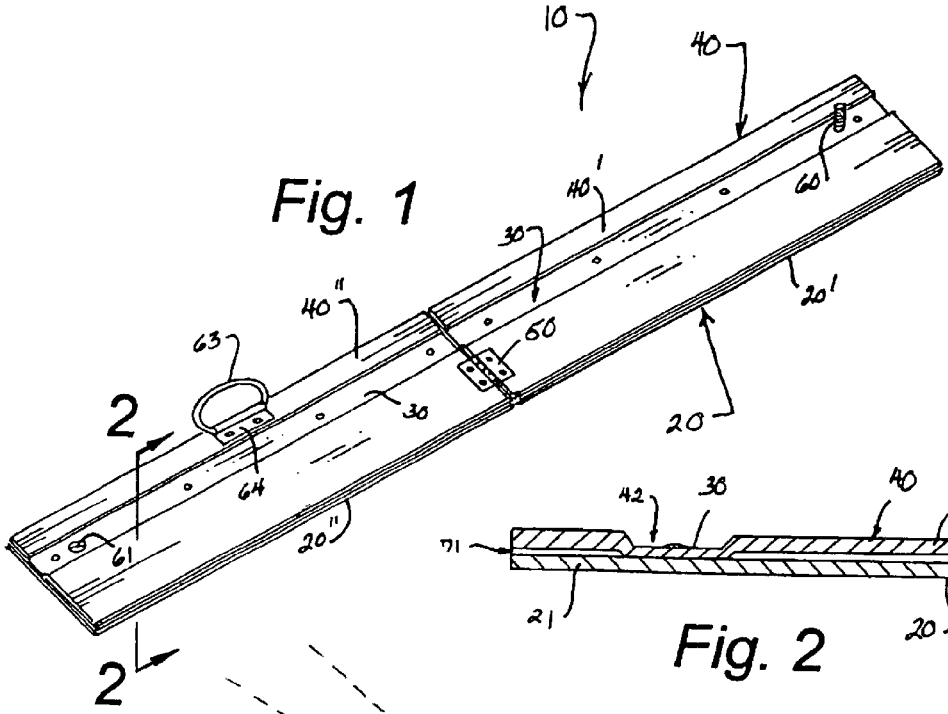
FIG. 1 is a perspective view of the hinged flashing fabrication tool that forms the basis of the present invention in the open position.

As can be seen by reference to the drawings, and in particular to FIG. 1, the flashing fabrication tool that forms the basis of the present invention is designated generally by the reference number 10. The fabrication tool 10 comprises in general an elongated rectangular base plate member 20, an elongated rectangular top plate member 40 connector means 30 for joining the top plate member 40 to the base plate member 20, and a hinge unit 50 the purpose and function of which will be explained presently.

In addition, the base plate member 20 and the top plate member 40 each comprises a pair of plate member segments 20' 20" and 40' 40" which are joined to one another by the hinge unit 50 wherein, one of the top plate member segments 20" is provided with a threaded post 60 that is dimensioned to pass through aligned apertures 61 in the joined top and base plate member segments 40" 20".

Furthermore one of the top plate member segments 40' 40" is provided with a handle element 63 that may be hingedly connected as at 64 to the selected top plate member segment 40" to transport the fabrication tool 10 to and from a work site.

Figure 3:
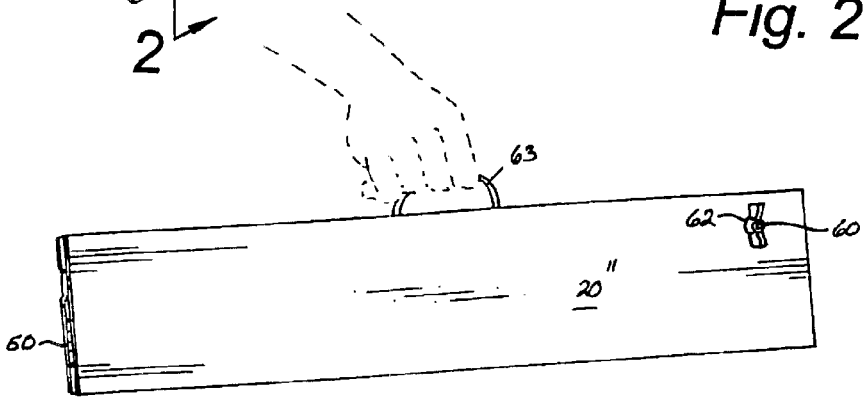
FIG. 3 is a perspective view of the flashing fabrication tool in the collapsed position.
Figure 4:
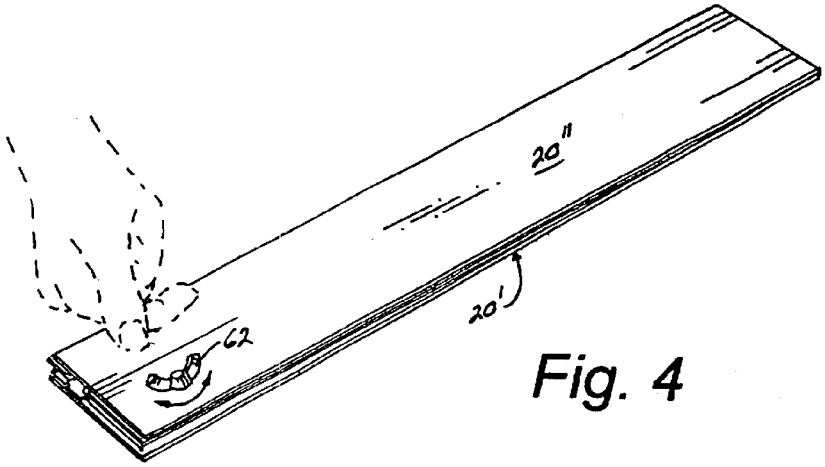
FIG. 4 is a perspective view of showing the tool prior to opening.
Figure 5:
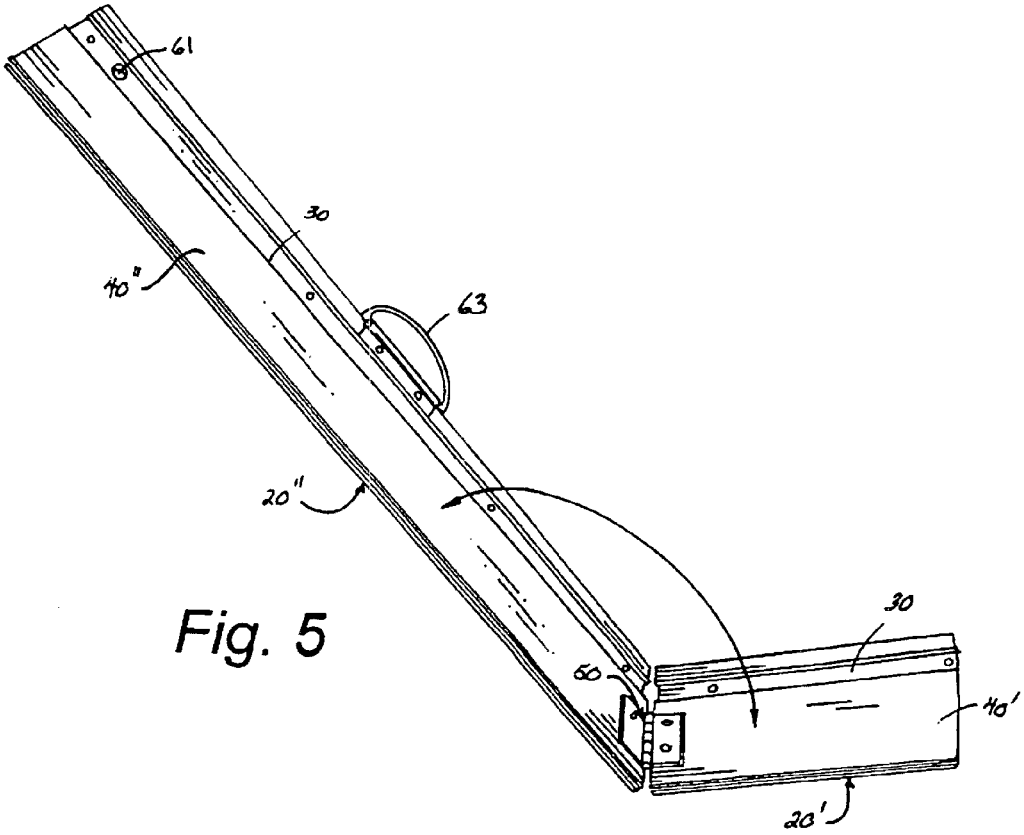
FIG. 5 shows the tool partially opened.

Turning now to FIGS. 3 through 5, it can be seen that in the collapsed position of the fabrication tool 10 the threaded post 60 passed through the aperture 61 and is engaged by a locking nut 63 that will secure the plate member segments 20' 40' and 20" 40" in its folded configuration for transport and storage purposes.

As shown in FIG. 1, both the base plate member 20 and the top plate member 40 have an effective length in excess of 30" and preferably at least 32" so that the length of the fabrication tool 10 is greater than the width of the standard 20" and 30" square chimney flues and, a width of at least 4" for reasons that will be explained in greater detail further on in the specification.

In addition, the base plate member 20 comprises a rigid flat steel plate 21 having a thickness of between ⅛ and ⅜ of an inch and the top plate member 40 starts off as a mirror image flat steel plate 41 which is further provided with an elongated longitudinal stamped recess 42 which is offset from the longitudinal axis of the top plate member 40 for reasons that will be explained presently.

Figure 2:
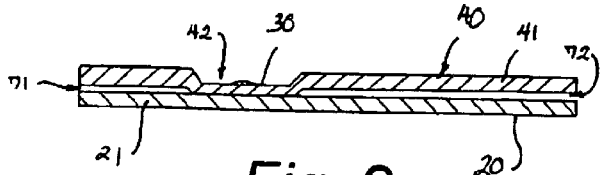
FIG. 2 is a cross-sectional view taken through line 2—2 of FIG. 1.

Still referring to FIGS. 2 and 3, it can be seen that the bottom of the stamped recess 42 is fixedly connected to the top of the base plate member 20 by either spot welding or space age adhesives to create two narrow slotted bending chambers 71 72 wherein, the depth of the recess 42 defines the width of the bending chamber openings and the stamped recess 42 forms a stiffening spine to prevent the flexure of the top plate member 40 relative to the base plate member 20.

Furthermore, it can also be seen that the bending chambers 71 72 comprise a truncated depth counter flashing bend chamber 71 and an elongated depth flashing bend chamber 72 wherein, in the preferred embodiment of the invention, the depth of the counter flashing bend chamber 71 has a depth of ⅝" and the flashing bend chamber 72 has a depth of 3½".

Figure 6:
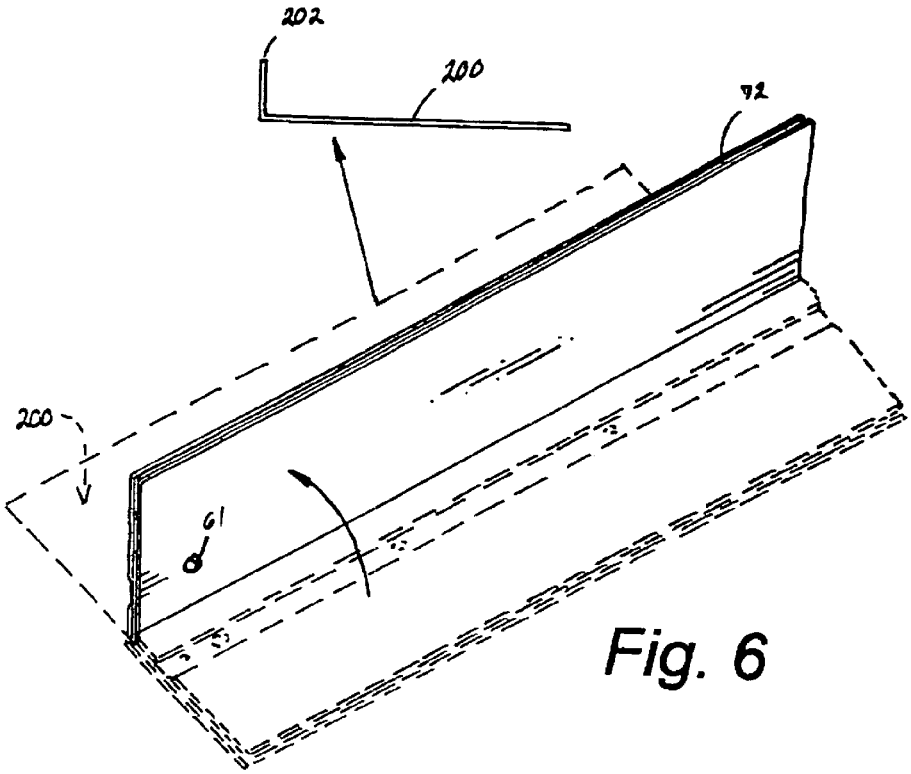
FIG. 6 shows one side of the tool fabricating a shallow flashing bend.
Figure 7:
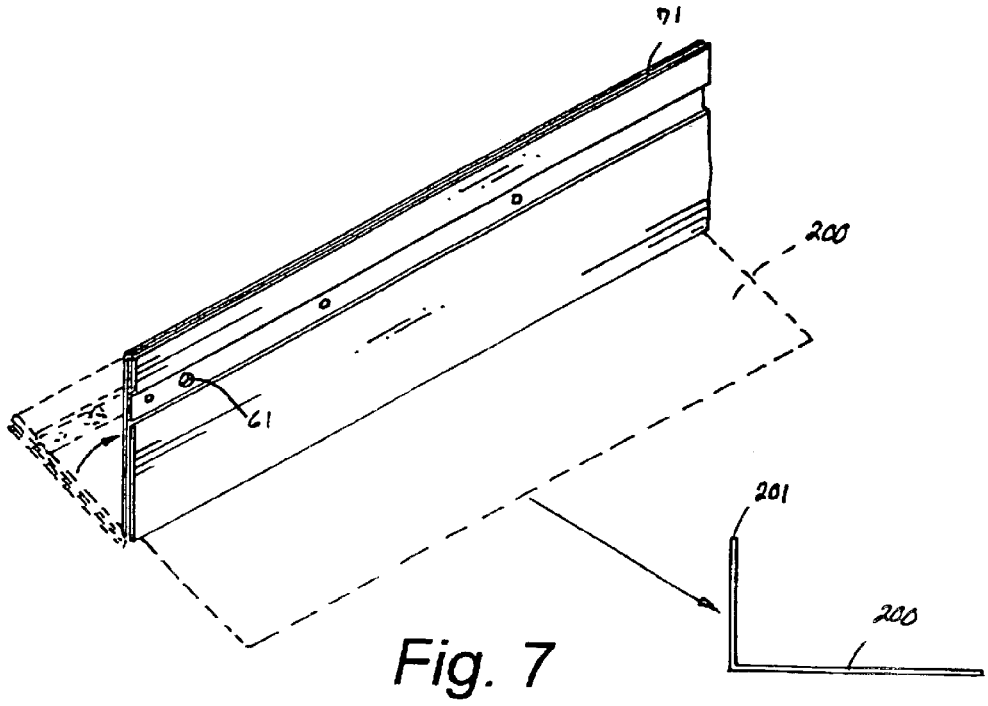
FIG. 7 shows the other side of the tool fabricating a deep flashing bend.

Turning now to FIGS. 6 and 7, it can be seen that the flashing fabrication tool 10 is employed in conjunction with a pre-cut strip of sheet metal 200 whereby, one elongated edge 201 of the strip of sheet metal 200 is inserted into the flashing bend chamber 71 to form the horizontal portion of a chimney flashing, and the other elongated edge 202 of the strip of sheet metal 200 is inserted into the counter flashing bend chamber 72 to form the vertical portion of a chimney flashing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breath and scope of the appended claims.

I claim:

1. A chimney flashing fabrication tool comprising an elongated rectangular base plate member; including a pair of base plate member segments an elongated rectangular top plate member including a pair of top plate member segments first means for joining the pair of top plate member segments to respective ones of the pair of base plate member segments to form first and second bending slots having uniform width openings wherein, the depth of the first bending slot is at least twice the depth of the second bending slot; and, second means for hingedly connecting the co-joined base plate member segments and top plate member segments to one another.

2. The fabrication tool as in claim 1; further comprising third means for captively yet releasably engaging the co-joined base plate member segments and top plate member segments in a folded position.

3. The fabrication tool as in claim 1; wherein, a selected one of the top plate member segments and the base plate member segments are provided with a handle element.

4. The fabrication tool as in claim 2; wherein, a selected one of the top plate member segments and the base plate member segments are provided with a handle element.

5. The fabrication tool as in claim 2; wherein, said third means comprises at least in part an aperture extending through one of the co-joined base plate member segments and top plate member segments and a post dimensioned to pass through said aperture wherein, the post is operatively connected to a selected one of the other of the co-joined base plate member segments and top plate member segments.

6. The fabrication tool as in claim 1; wherein, said top plate member is provided with a longitudinal stamped recess that is parallel to and offset from the longitudinal axis of the top plate member.

7. The fabrication tool as in claim 6; wherein, the base plate member has a top surface and the stamped recess of the top plate member has a bottom surface which is fixedly connected to the top surface of the base plate member.

8. The fabrication tool as in claim 7; wherein, the fixed connection is formed by spot welding.

9. The fabrication tool as in claim 7; wherein, the fixed connection is formed by space age adhesives.

10. The fabrication tool as in claim 6; wherein, the depth of the stamped recess is equal to the width of the bending slot openings.

11. The fabrication tool as in claim 5; wherein, said post is threaded.

12. The fabrication tool as in claim 11; wherein, said third means further comprises a locking nut adapted to engage the threaded post.

* * * * *